US006053803A

United States Patent [19]

Pizzimenti et al.

[11] Patent Number: 6,053,803

[45] Date of Patent: Apr. 25, 2000

[54] APPARATUS AND METHOD FOR GENERATING A PRESSURIZED FLUID STREAM HAVING ABRASIVE PARTICLES

[75] Inventors: Stephen Pizzimenti, Piscataway; Mark T. McClung, New Brunswick, both of N.J.

[73] Assignee: S.S. White Technologies Inc., Piscataway, N.J.

[21] Appl. No.: 08/931,560

[22] Filed: Sep. 16, 1997

[51] Int. Cl.[7] ..... B24C 5/04

[52] U.S. Cl. ..... 451/102; 451/75

[58] Field of Search ..... 451/102, 75; 239/336, 239/379, 494, 493

[56] References Cited

U.S. PATENT DOCUMENTS

| | | | |
|---|---|---|---|
| 2,508,766 | 5/1950 | Morel . | |
| 2,594,735 | 4/1952 | Crumley . | |
| 2,807,442 | 9/1957 | Ledgerwood, Jr. | 451/102 |
| 2,990,653 | 7/1961 | Browning . | |
| 3,972,150 | 8/1976 | Hart . | |
| 4,165,587 | 8/1979 | Cottingham et al. . | |
| 4,193,550 | 3/1980 | Juttelstad et al. | 451/102 |
| 4,412,402 | 11/1983 | Gallant | 451/102 |
| 4,462,803 | 7/1984 | Landgraf et al. | 451/102 |
| 4,552,597 | 11/1985 | Gallant | 451/102 |
| 4,945,688 | 8/1990 | Yie | 451/102 |
| 5,409,418 | 4/1995 | Krone-Schmidt et al. | 451/102 |
| 5,456,629 | 10/1995 | Bingham | 451/102 |
| 5,733,174 | 3/1998 | Bingham et al. | 451/102 |
| 5,779,523 | 7/1998 | Mesher | 451/102 |

*Primary Examiner*—David A. Scherbel
*Assistant Examiner*—Derris Holt Banks
*Attorney, Agent, or Firm*—Michaelson & Wallace; Peter L. Michaelson; Jeremiah G. Murray

[57] ABSTRACT

An abrasive nozzle assembly comprises a casing, a nozzle head and an abrasive nozzle mounted coaxially to generate a high-velocity abrasive airstream. The nozzle head has a cavity with a nozzle orifice. The casing includes an air passage, which communicates, at one end, with a compressed air supply tube and, at another end, with the cavity. The abrasive nozzle includes an abrasive supply tube which passes axially through the casing and cavity to terminate at the nozzle orifice. A compressed air source feeds the compressed air supply tube. An abrasive mixture source feeds the abrasive supply tube. The abrasive nozzle acts as a primary nozzle directing a narrow abrasive airstream from the center of the nozzle orifice. The nozzle head, which acts as a secondary nozzle, discharges a ring-shaped, high-velocity, abrasive-free airstream from the periphery of the nozzle orifice. Within a short distance downstream from the nozzle orifice, the abrasive-free airstream and the abrasive airstream gradually diverge toward each other and mix to form the high-velocity abrasive airstream.

16 Claims, 4 Drawing Sheets

APPARATUS AND METHOD FOR GENERATING A PRESSURIZED FLUID STREAM HAVING ABRASIVE PARTICLES

BACKGROUND OF THE INVENTION

1. Field of the Invention

The invention relates to abrasive blasting techniques and, more particularly, to apparatus and methods for generating a pressurized stream having abrasive particles.

2. Description of the Prior Art

Abrasive blasting has been used successfully to polish, etch, abrade, cut, drill, clean or otherwise process a variety of materials. Abrasive blasting typically involves a process in which a fluid and abrasive particles are blended together to form an abrasive mixture. This abrasive mixture is then sent through a nozzle to direct a pressurized stream, containing abrasive particles, at the surface of an object. Conventional abrasive blasting apparatus have been used in a variety of applications ranging from the removal of rust from bridges to the restoration of oil paintings.

High-performance abrasive blasting machines have been developed that produce an accurate abrasive stream using pressurized air and fine powders formed from such materials as crushed glass, silicone carbide and aluminum oxide. These high-performance machines often display great versatility; they can possess sufficient power to cut and drill materials as hard as diamonds as well as the precision to delicately clean debris from fragile items like fabric and paper. High-performance blasting apparatus typically include a chamber in which high-pressure air and a very fine powder are mixed to form an abrasive mixture. The chamber feeds the abrasive mixture to a small, precisely machined nozzle which dispenses the mixture as an accurately shaped, narrow airstream in which the fine powder particles move at relatively high speeds. Achieving the full potential and versatility of precision abrasive blasting machines, however, requires the proper application of a number of key variables, including: air pressure, powder flow rate, nozzle size, type of powder, nozzle distance to a workpiece, and nozzle angle with respect to the workpiece.

Specifically, the air pressure at which an abrasive mixture is fed to a nozzle is directly related to the velocity of the abrasive particles striking a workpiece. The higher the air pressure, the faster the particles move and the greater the cutting speed is. The lower the air pressure, the slower the particles and the lower the cutting speed.

The number of abrasive particles exiting a nozzle per unit of time is referred to as the "particle flow rate". Generally, the greater the particle flow rate, the greater the cutting action. In order to achieve better cutting action with higher particle flow rates, it is often necessary to also increase the air pressure of the abrasive mixture to maintain particle velocity, which tends to decrease as airstream mass increases. Cutting action can also decrease quickly at very high particle flow rates due to turbulence caused by, for example, interference between the particles bouncing off the workpiece and those coming out of the nozzle. At extremely high air pressures and flow rates, turbulence can also be created within the nozzle, which can further slow the particles and decrease the cutting action.

The nozzle size and shape normally determine the area that will be impacted by the abrasive particles. The larger a nozzle exit area is, the greater the impact area is. Also, the distance and angle between a nozzle tip and the workpiece play a large part in determining the area covered as well as the cutting rate.

The type of abrasive particles is also an important variable in a typical high-precision abrasive blast process. For instance, in order to achieve consistent, sputter-free, streamlined flow from a nozzle, it is usually necessary to use uniformly sized particles. When the particles vary in size, they tend to clump together as smaller particles fill in gaps between the larger particles, thereby adversely effecting the flow characteristics.

One of the most critical problems confronting designers of precision abrasive blasting methods and apparatus has been developing techniques for increasing the velocity of the particles while maintaining a highly accurate abrasive airstream. In that regard, it has been generally recognized that simply increasing the air pressure of an abrasive mixture to achieve an accurate airstream with greater particle speeds has its limitations. For instance, extreme air pressures can adversely effect an airstream by distorting its shape, size and flow as that airstream exits a nozzle. Also, interior walls and tips of conventional nozzles normally experience excessive wear when conveying abrasive particles traveling at relatively high velocities. Consequently, those concerned with the development of high-precision abrasive blasting equipment have recognized the need for improved techniques of increasing the speed of abrasive particles while maintaining an accurate abrasive stream and avoiding undue nozzle wear.

SUMMARY OF THE INVENTION

The present invention meets this need in the art by providing a technique that relies on using an abrasive nozzle assembly with a plurality of nozzle outputs that discharge different streams, which mix together so as to produce an accurate, high-velocity abrasive stream.

Specifically, the present invention provides an abrasive nozzle assembly comprising a primary nozzle for forming an abrasive fluid stream having abrasive particles traveling at a first speed. A secondary nozzle forms an abrasive-free fluid stream symmetrically disposed adjacent the abrasive fluid stream. The abrasive-free fluid stream travels at a second speed greater than the first speed.

According to another aspect of the invention, an abrasive nozzle assembly comprises a nozzle head having a nozzle orifice in communication with a fluid passage. An abrasive nozzle, having a nozzle tip with an exit opening, mounts such that the nozzle tip is located adjacent the nozzle orifice. The nozzle assembly simultaneously discharges an abrasive mixture from the exit opening and an abrasive-free fluid from the nozzle orifice, which mix to form a high-velocity abrasive stream.

Still, another aspect of the invention includes an abrasive nozzle system comprising a primary nozzle having a primary exit area. A secondary nozzle has a secondary exit area located adjacent the primary exit area. A pressurized abrasive source connects to the primary nozzle. An abrasive-free, pressurized fluid source connects to the secondary nozzle. Flow discharges from the primary exit area and the secondary exit area, which are concentrically disposed in a common plane, mix to form a high-velocity abrasive stream.

A further aspect of the invention includes a method of forming an abrasive fluid stream comprising the steps of: forming a pressurized abrasive mixture having abrasive particles suspended in a pressurized fluid; discharging an abrasive flow containing the pressurized abrasive mixture; discharging an abrasive-free flow of the fluid adjacent to the abrasive flow; and forming the abrasive fluid stream by mixing the abrasive flow and the abrasive-free flow. As a further aspect of the invention, the method also includes directing the abrasive flow as a narrow stream, directing the abrasive-free flow as a ring-shaped stream parallel to and symmetrically encircling the narrow stream and discharging the abrasive-free flow at a greater velocity than the abrasive flow.

BRIEF DESCRIPTION OF THE DRAWINGS

The teachings of the present invention can be readily understood by considering the following detailed description in conjunction with the accompanying drawings, in which.

DETAILED DESCRIPTION OF THE PREFERRED EMBODIMENT

Figure 1:
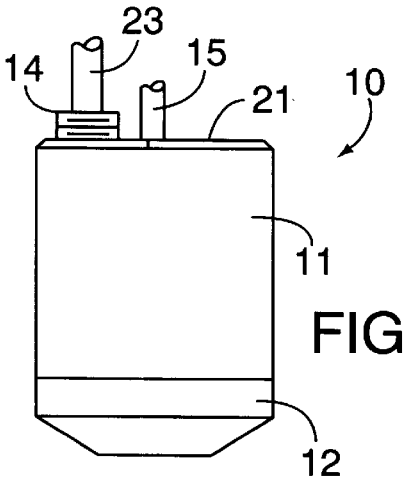
FIG. 1 is a front elevation of a preferred embodiment of a nozzle assembly in accordance with the present invention.

Referring now to the drawings, nozzle assembly 10 comprises casing 11, nozzle head 12 and abrasive nozzle 16. As shown in detail in FIGS. 1–5, casing 11 comprises passages 17 and 18 each of which extend from upper face 21 to threaded socket 13. Threaded fitting 14 on one end of air supply tube 23 mates with a threaded upper end of passage 17. Air supply tube 23 feeds abrasive-free pressurized air to nozzle assembly 10 via passage 17, which communicates with the interior of threaded socket 13.

Figure 3:
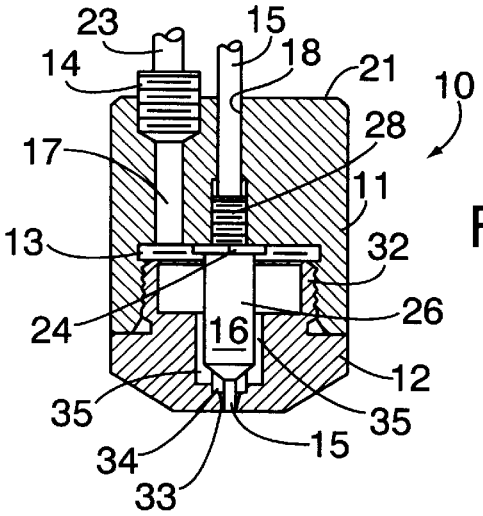
FIG. 3 is an elevation in cross section taken on the line 3—3 of FIG. 2 looking in the direction of the arrows.

Abrasive nozzle 16, shown in detail in FIGS. 3 and 6–8, includes body 26, threaded fitting 28, hexagonal flange 24 and abrasive supply tube 15. A mid-section of abrasive supply tube 15 is fixed within axial passage 27, which extends from tapered nose 29 on body 26 to threaded fitting 28. As shown in FIG. 3, threaded fitting 28 mates with a threaded socket in the lower end of passage 18. Abrasive supply tube 15 is preferably fabricated from a relatively hard material, such as carbide, so that it can convey an abrasive mixture at limited speeds without significant structural wear.

Figure 9:
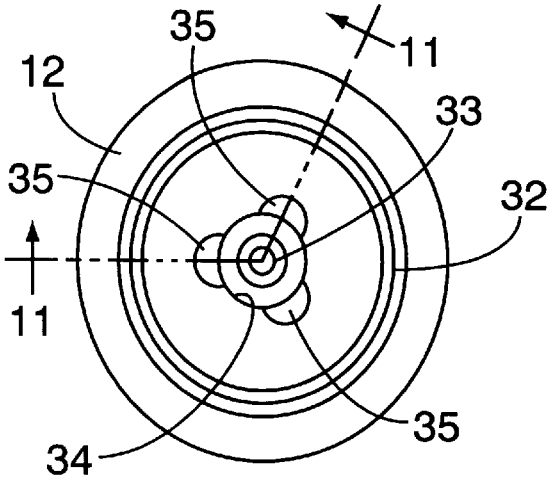
FIG. 9 is a top plan view of a nozzle head which forms a portion of the nozzle assembly of FIGS. 1–3.
Figure 10:
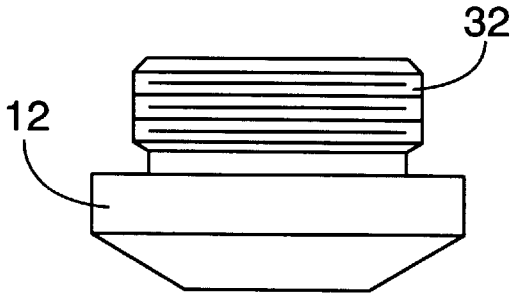
FIG. 10 is front elevation of the nozzle head of FIG. 9.
Figure 11:
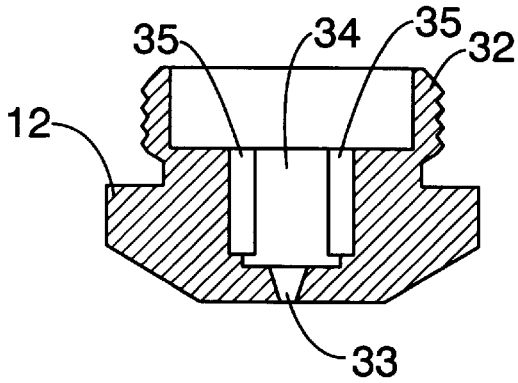
FIG. 11 is a revolved cross section taken on the line 11—11 of FIG. 9 looking in the direction of the arrows.

Nozzle head 12, shown in detail in FIGS. 3 and 9–11, includes threaded collar 32, nozzle orifice 33, and cylindrical cavity 34. FIG. 3 shows threaded collar 32 mating with threaded socket 13 while body 26 fits snugly within cavity 34. Three grooves 35, cut into the walls of cavity 34, form three air passages which permit pressurized air to flow from air supply tube 23, passage 17, socket 13 and collar 32 into the lower region of cavity 34 and out the periphery of nozzle orifice 33. Grooves 35, as seen in FIG. 9, are symmetrically spaced at approximately 120-degree intervals about a cylindrical (longitudinal) axis (not specifically shown) of cavity 34.

Figure 2:
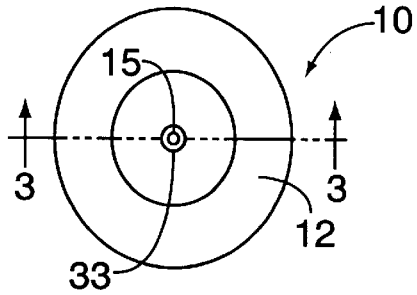
FIG. 2 is a bottom plan view of the nozzle assembly of FIG. 1.
Figure 12:
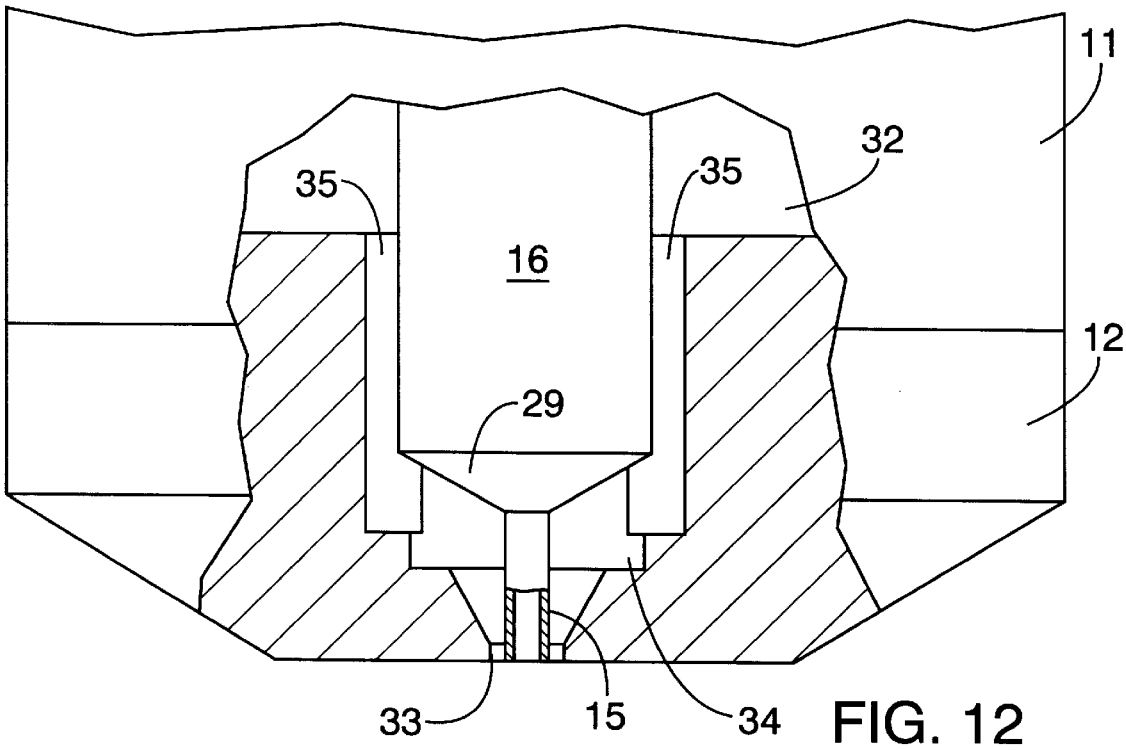
FIG. 12 is an enlarged elevation, with parts broken away and parts shown in a revolved cross section similar to FIG. 11, which shows a portion of the nozzle assembly of FIGS. 1–3.
Figure 13:
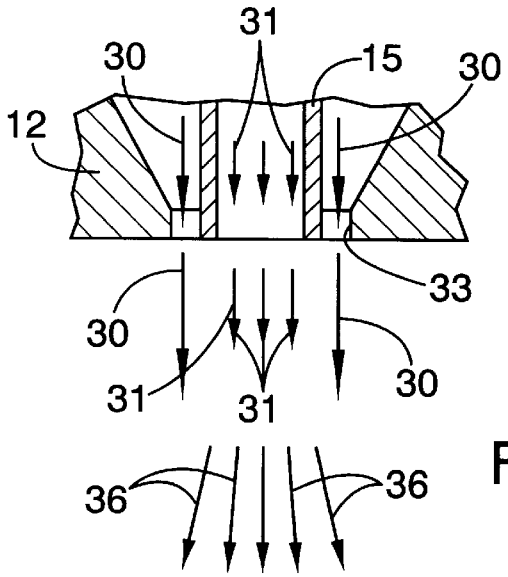
FIG. 13 is an enlarged elevation of a portion of the view shown in FIG. 12.

With reference to all figures and in particular FIGS. 3, 12 and 13, nozzle assembly 10 is preferably assembled in the following manner. First, abrasive flow tube 15 is cemented or otherwise fixed within passage 27 to form abrasive nozzle 16. Second, abrasive nozzle 16 is coupled to casing 11 by passing the upper portion of flow tube 15 into passage 18 and then threading fitting 28 into passage 18 until hexagonal flange 24 abuts the upper surface of socket 13. Third, nozzle head 12 is coupled to casing 11 by placing collar 32 and cavity 34 over abrasive nozzle 16 and then threading collar 32 into socket 13 until the outer walls of casing 11 and nozzle head 12 meet. This action causes the lower tip of abrasive flow tube 15 to be coaxially located within the center of nozzle orifice 33, as best seen in FIGS. 2, 12 and 13.

Figure 14:
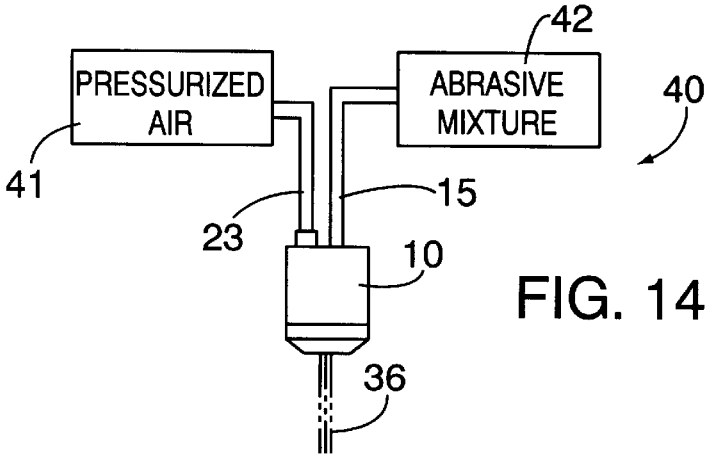
FIG. 14 is a schematic diagram showing a high-performance abrasive blasting apparatus comprising the nozzle assembly of FIGS. 1–13.
Figure 4:
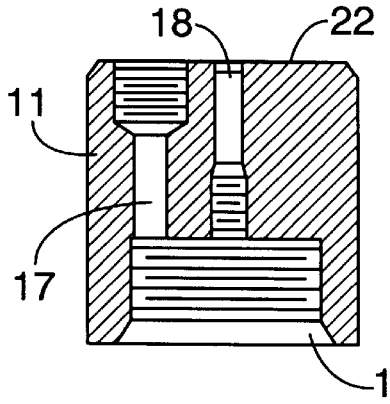
FIG. 4 is an elevation of a casing in cross section taken on the line 4—4 of FIG. 5 looking in the direction of the arrows.
Figure 5:
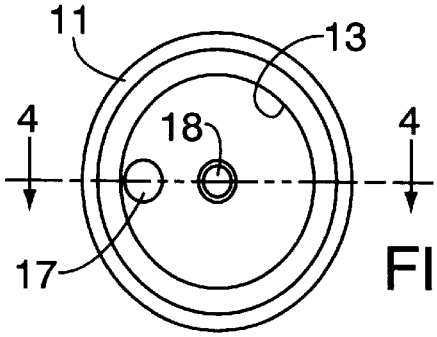
FIG. 5 is a bottom plan view of the casing shown in FIG. 4.
Figure 6:
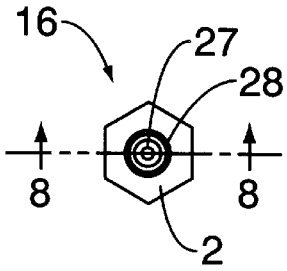
FIG. 6 is a top plan view of an abrasive nozzle which forms a portion of the nozzle assembly of FIG. 1.
Figure 7:
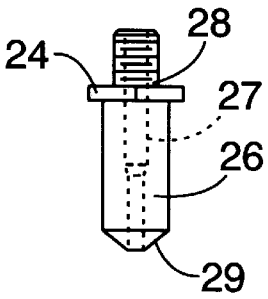
FIG. 7 is a front elevation of a body portion of the abrasive nozzle of FIGS. 6 and 8.
Figure 8:
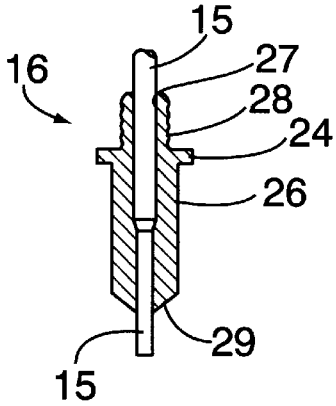
FIG. 8 is a cross section taken on the line 8—8 of FIG. 6 looking in the direction of the arrows.

FIG. 14 schematically illustrates abrasive blasting system 40 discharging abrasive airstream 36 from nozzle assembly 10. Abrasive blasting system 40 includes abrasive source 42, which, when activated, feeds an abrasive mixture to abrasive supply tube 15. Abrasive blasting system 40 also includes pressurized air source 41 connected to air supply tube 23 for feeding pressurized air to nozzle head 12. As seen in FIG. 13, the lower tip of tube 15, positioned at the center of nozzle orifice 33, acts as a primary nozzle dispensing abrasive airstream 31. Head 12 dispenses airstream 30 at the periphery of nozzle orifice 33, which acts as a secondary nozzle. Abrasive airstream 31 normally contains a precise mixture of pressurized air and abrasive particles while airstream 30 contains pressurized air only.

Consequently, nozzle assembly 10 comprises primary and secondary nozzles having concentric exit areas at nozzle orifice 33 which dispense different output streams. Specifically, nozzle orifice 33 includes a center area through which the tip of abrasive flow tube 15 can dispense an accurately shaped, narrow abrasive airstream 31, and a relatively narrow, ring-shaped outer area through which an accurately shaped stream of pressurized air forms as airstream 30. As seen in FIG. 13, airstream 30 encircles abrasive airstream 31 when exiting nozzle orifice 33. Using arrows of different lengths, FIG. 13 depicts airstream 30 as traveling at a greater velocity than that of abrasive airstream 31. Within a relatively short distance downstream from nozzle orifice 33, airstream 30 and abrasive airstream 31 gradually diverge toward each other and mix to form abrasive airstream 36, traveling at an intermediate speed as depicted in FIG. 13 with arrows of intermediate length.

A user of abrasive blasting system 40, shown in FIG. 14, may perform conventional abrasive blasting by disabling pressurized air source 41, activating abrasive source 42 and using only abrasive airstream 31 in a well known manner. Alternatively, a user of abrasive blasting system 40 can execute high-velocity, precision abrasive blasting, with particles traveling above conventional velocities, by activating both sources 41 and 42.

Specifically, in a typical application where a conventional abrasive airstream is to be generated, the user disables pressurized air source 41 and then, in a well known manner, adjusts the air pressure and abrasive mixture of abrasive source 42 such that abrasive airstream 31 has the desired flow rate and/or particle velocity as it exits nozzle orifice 33. As discussed above, the higher the air pressure delivered by abrasive source 42, the faster the abrasive particles in abrasive airstream 31 will travel. However, as also discussed above, simply increasing the air pressure of an abrasive mixture at its source to achieve greater output particle speeds and/or particle flow rates has its limitations. For instance, if excessive air pressures are used at abrasive source 42 to increase particle speeds, the resulting flow of the abrasive mixture in supply tube 15 can be adversely effected. Additionally, an abrasive mixture with particles traveling at excessively high speeds can cause excessive wear to the primary nozzle, i.e., the interior walls and tip of supply tube 15. To avoid excessive particle speeds and, therefore, undue nozzle wear and/or airstream distortions, limiting values for the air pressure and the particle flow rate of the abrasive mixture are normally specified to limit the particle speeds. As a typical example, some high-precision, carbide-lined abrasive nozzles are designed to operate with abrasive mixtures having pressures up to 140 pounds per square inch gauge, and particle flow rates up to 55 grams per minute.

Alternatively, when using abrasive blasting system 40 as a generator of a high-velocity, accurate abrasive airstream, a user activates abrasive source 42 and pressurized air source 41. The user may first adjust the air pressure and particle flow rate at abrasive source 42 to any desired values below the specified limiting values and then adjust the air pressure of pressurized air source 41 to a value such that the speed of airstream 30 exceeds the speed of the abrasive particles in abrasive airstream 31. As abrasive airstream 31 and airstream 30 mix downstream to form abrasive airstream 36, the high speed of airstream 30 will boost the abrasive particles in abrasive airstream 31 to higher speeds.

Although the speed of airstream 30 can be quite high, its shape, size and flow characteristics can be accurately maintained. Additionally, the abrasive-free air being fed from pressurized source 41 will generally not cause undue wear of the nozzle parts. Further, because the air pressure and flow rates at abrasive source 42 are set below specified limiting values, the user can be assured of minimal nozzle wear, a streamlined flow within supply tube 15, and an accurate abrasive airstream 31. For example, if abrasive nozzle 16 contained a typical high-precision, carbide supply tube 15 that is designed to deliver an abrasive mixture having pressures up to 140 pounds per square inch gauge, pressurized source 41 could be set to deliver abrasive-free air at pressures up to 200 pounds per square inch gauge. The axial symmetry of collar 32, grooves 35, cavity 34 and the ring-shaped outer area of nozzle orifice 33 help to insure that airstream 30 smoothly encircles abrasive airstream 31, causing no significant distortions and thereby insuring the accuracy of the shape, size and streamlined flow characteristics of the resulting downstream abrasive airstream 36.

Obviously many modifications and variations of the present invention are possible in the light of the above teachings. For example, users can adjust airstream 30 to lower speeds, at or below the speed of abrasive airstream 31, thereby using a low-speed airstream 30 as a means of shielding, shaping or otherwise effecting abrasive airstream 31. Further, although the drawings show nozzle orifice 33 as having a circular shape, other shapes are contemplated. As indicated above, the particular size and shape of a nozzle orifice normally determines the size and shape of the area that will be impacted by the abrasive particles. Consequently, the shapes of nozzle orifice 33 and the lower tip of abrasive supply tube 15 may be any of a variety of concentric shapes, such as concentric rectangles. It is to be understood, therefore, that within the scope of the appended claims, the invention may be practiced otherwise than as specifically described.

What is claimed is:

1. An abrasive nozzle assembly comprising:

a primary nozzle means, having a primary exit port, for forming an abrasive fluid stream having abrasive particles traveling at a first speed upon discharge from said primary exit port; and a secondary nozzle means, having a secondary exit port neighboring said primary exit port, for forming an abrasive-free fluid stream symmetrically disposed adjacent said abrasive fluid stream, said abrasive-free fluid stream traveling at a second speed substantially greater than said first speed upon discharge from said secondary exit port.

2. The abrasive nozzle assembly of claim 1 wherein said secondary nozzle means includes means for forming said abrasive-free fluid stream to be concentrically disposed with respect to and contiguous with said abrasive fluid stream after said abrasive-free fluid stream discharges from said secondary exit port.

3. The abrasive nozzle assembly of claim 2 wherein said primary nozzle means includes means for discharging said abrasive fluid stream from said primary exit port with a linearly directed streamlined flow, and said secondary nozzle means includes means for discharging said abrasive-free fluid stream from said secondary exit port as a ring-shaped stream substantially parallel to and symmetrically encircling said abrasive fluid stream.

4. The abrasive nozzle assembly of claim 3 further including a pressurized air source connected to said secondary nozzle means and an abrasive mixture source, containing said abrasive particles suspended in pressurized air, connected to said primary nozzle means.

5. An abrasive nozzle assembly comprising:

a fluid passage;

a nozzle head having a nozzle orifice, and a cavity in communication with said nozzle orifice and said fluid passage; and an abrasive nozzle having a nozzle tip with an exit opening, and said abrasive nozzle extending into said cavity with said nozzle tip located adjacent to and extending coaxially within said nozzle orifice.

6. The abrasive nozzle assembly of claim 5 further including a casing joined to said nozzle head, and wherein said abrasive nozzle mounts to said casing and extends through said cavity into a center area of said nozzle orifice.

7. The abrasive nozzle assembly of claim 6 wherein said nozzle head includes parallel grooves extending along the side of said abrasive nozzle and communicating with said fluid passage and said cavity.

8. The abrasive nozzle assembly of claim 7 wherein said abrasive nozzle includes an abrasive supply tube, and wherein said fluid passage and said abrasive supply tube extend through said casing.

9. The abrasive nozzle assembly of claim 8 wherein said grooves are symmetrically spaced about the axis of said nozzle orifice.

10. The abrasive nozzle assembly of claim 9 further including a pressurized air source connected to said fluid passage and an abrasive mixture source connected to said abrasive supply tube.

11. An abrasive nozzle system comprising:

a primary nozzle having a primary exit area contiguous with an exterior of said nozzle system;

a secondary nozzle having a secondary exit area located adjacent to and lying in a common plane with said primary exit area, and said secondary exit area contiguous with said exterior of said nozzle system;

a pressurized abrasive source connected to said primary nozzle; and an abrasive-free, pressurized fluid source connected to said secondary nozzle.

12. An abrasive nozzle system comprising:

a primary nozzle having a primary exit area;

a secondary nozzle having a secondary exit area located adjacent said primary exit area, and a cavity communicating with said secondary exit area and said fluid source, and wherein said primary nozzle mounts in said cavity with said primary exit area and said secondary exit area concentrically disposed in a common plane;

a pressurized abrasive source connected to said primary nozzle; and an abrasive-free, pressurized fluid source connected to said secondary nozzle.

13. The abrasive nozzle system of claim 12 wherein said secondary nozzle includes parallel grooves communicating with said cavity and symmetrically spaced about said primary nozzle.

14. A method of forming an abrasive fluid stream comprising:

forming a pressurized abrasive mixture having abrasive particles suspended in a pressurized fluid;

discharging, from an exit port of a first nozzle, an abrasive flow containing said pressurized abrasive mixture, said abrasive flow being discharged at a first speed;

discharging, from an exit port of a second nozzle, an abrasive-free flow of said fluid adjacent to said abrasive flow, said abrasive-free flow being discharged at a second speed substantially greater than said first speed; and forming said abrasive fluid stream by mixing said abrasive flow and said abrasive-free flow in a region exterior to said first and second nozzles.

15. The method of claim 14 wherein said step of discharging said abrasive flow includes directing said abrasive flow linearly as a narrow solid stream with said abrasive particles distributed throughout said stream, and said step of discharging said abrasive-free flow includes directing said abrasive-free flow as a ring-shaped stream substantially parallel to and symmetrically encircling said narrow solid stream.

16. The method of claim 14 wherein said step of forming a pressurized abrasive mixture includes suspending said abrasive particles in pressurized air in a gaseous state, and said step of discharging said abrasive-free flow includes discharging an abrasive-free airstream.

* * * * *